US005476163A

United States Patent [19]

Wu

[11] Patent Number: 5,476,163

[45] Date of Patent: Dec. 19, 1995

[54] RETRACTABLE HANDLE MECHANISM FOR A SUITCASE

[76] Inventor: Yun-Pi Wu, 5 Fl., 31, Alley 25, Lane 90, Sec. 6, Min Chuan E. Rd., Taipei, Taiwan

[21] Appl. No.: 258,083

[22] Filed: Jun. 10, 1994

[51] Int. Cl.[6] ..... A45C 5/14; A45C 13/04; A45C 13/26

[52] U.S. Cl. ..... 190/115; 190/39; 190/127; 16/115

[58] Field of Search ..... 190/39, 115–118; 280/37, 43.315, 43.371, 655.1; 16/112, 115

[56] References Cited

U.S. PATENT DOCUMENTS

| | | | |
|---|---|---|---|
| 627,374 | 6/1899 | Wood | 190/115 |
| 3,842,953 | 10/1974 | Royet | 190/18 A |
| 4,087,102 | 5/1978 | Sprague | 190/18 A X |
| 4,995,487 | 2/1991 | Plath | 190/115 X |
| 5,181,590 | 6/1993 | Carpenter et al. | 190/115 X |
| 5,295,565 | 3/1994 | Latshaw | 190/18 A |

*Primary Examiner*—Sue A. Weaver
*Attorney, Agent, or Firm*—Bacon & Thomas

[57] ABSTRACT

A retractable supporting mechanism for a suitcase includes a rod assembly, a retaining bushing assembly and a retaining plate. This supporting mechanism can be readily attached to the main frame of the suitcase and is completely enclosed by a sandwiched pocket having an opening incorporated with a zipper. By this arrangement, the rod assembly can be pulled out to a full extent in use and retracted to a compact position when not in use. The rod assembly is integrally molded and cannot be pulled out from the retaining plate.

2 Claims, 4 Drawing Sheets

RETRACTABLE HANDLE MECHANISM FOR A SUITCASE

BACKGROUND OF THE INVENTION (a) Field of the Invention

This invention relates to a handle mechanism for a suitcase, more particularly, to a retractable handle supporting mechanism for a suitcase which facilitates a compact configuration. Accordingly, this mechanism facilitates easy and convenient assembling.

(b) Description of the Prior Art

The handle mechanism for a suitable generally includes a retractable handle which can be fully extended in transport and fully retracted after use and a wheel assembly at the lower end for easy transportation. This mechanism is generally installed at the one side of the suitcase, with such a suitcase being generally disclosed in the U.S. Pat. No. 4,995,487, issued to Plath on Feb. 26, 1991. But the above described supporting mechanism has the following defect and inconvenience in assembling. The rod of a U-shape handle member is received by a sleeve and interconnected with an offset guide means. The length of the rod shall be made longer than the length of the sleeve at one end, and the rod shall be received by the sleeve in such a manner that the distal end of the rod shall exceed the bottom end of the sleeve. After the offset guide means is completely installed, the rod is again retracted into the sleeve. Then cap is used to seal the bottom end of the sleeve. Through this complicated arrangement, the mechanism is assembled. It is obvious that this assembling process is complicated and expensive and cannot be put into a mass production. Furthermore, once the interconnection between the rod and the offset guide means is loosened, the U-shape handle member will pull out from the sleeve and cause the mechanism to completely malfunction. Apparently, this is not a good design.

SUMMARY OF THE INVENTION

It is the object of this invention to provide a retractable handle mechanism for a suitcase. This mechanism has a compact, rigid and more effective configuration which can be easily and economically assembled. On the other hand, since the mechanism has a more rigid configuration, its service life is accordingly prolonged.

BRIEF DESCRIPTION OF THE DRAWINGS

The structural and operational characteristics of the present invention and its advantages as compared to the known state of the prior art will be better understood from the following description, in conjunction with the attached drawings which show illustratively but not restrictively an example of a retractable supporting mechanism for a suitcase. In the drawings.

DETAILED DESCRIPTION OF PREFERRED EMBODIMENT

Figure 1:
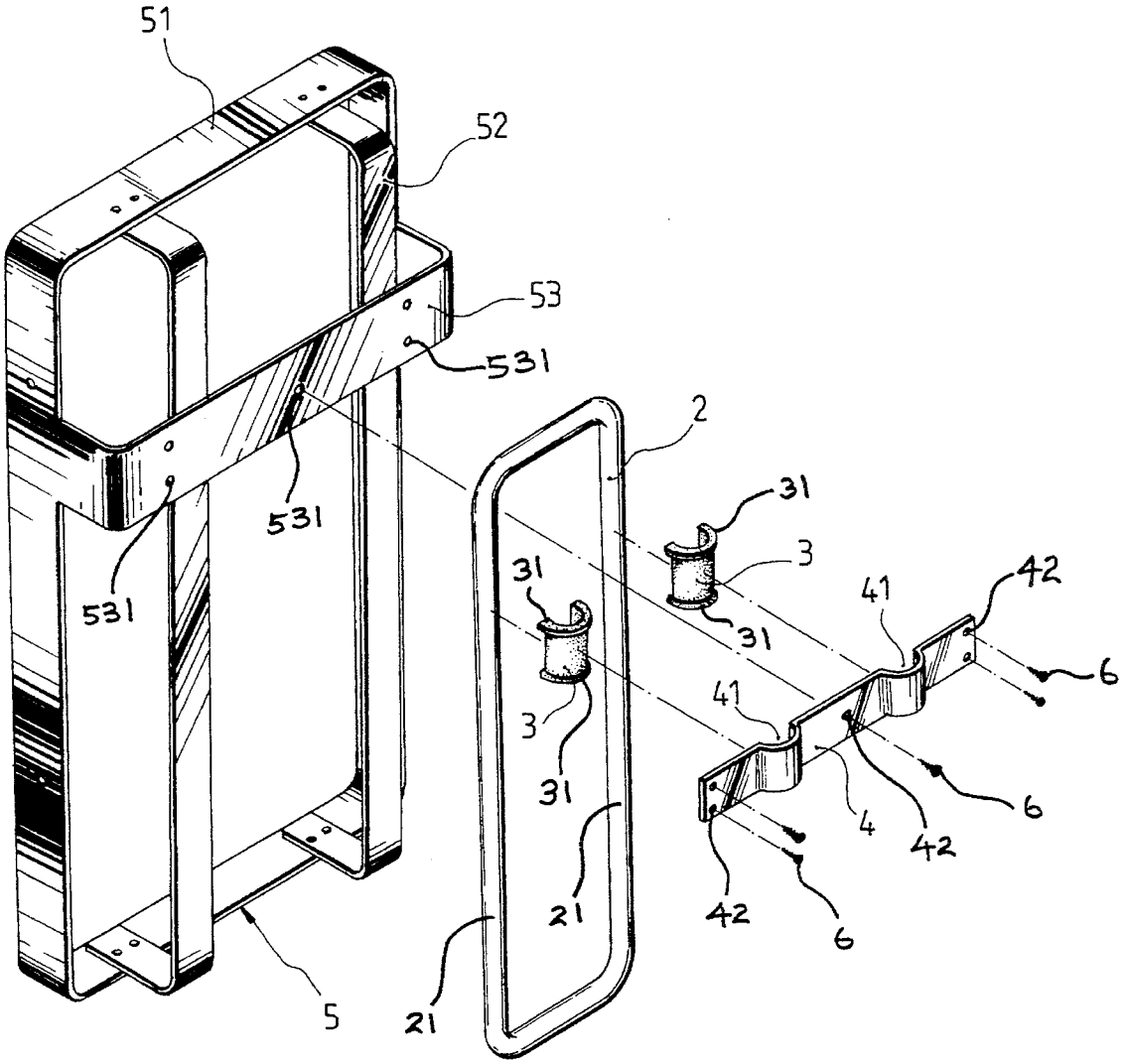
FIG. 1 is an exploded perspective view of the retractable handle mechanism made according to this invention.
Figure 2:
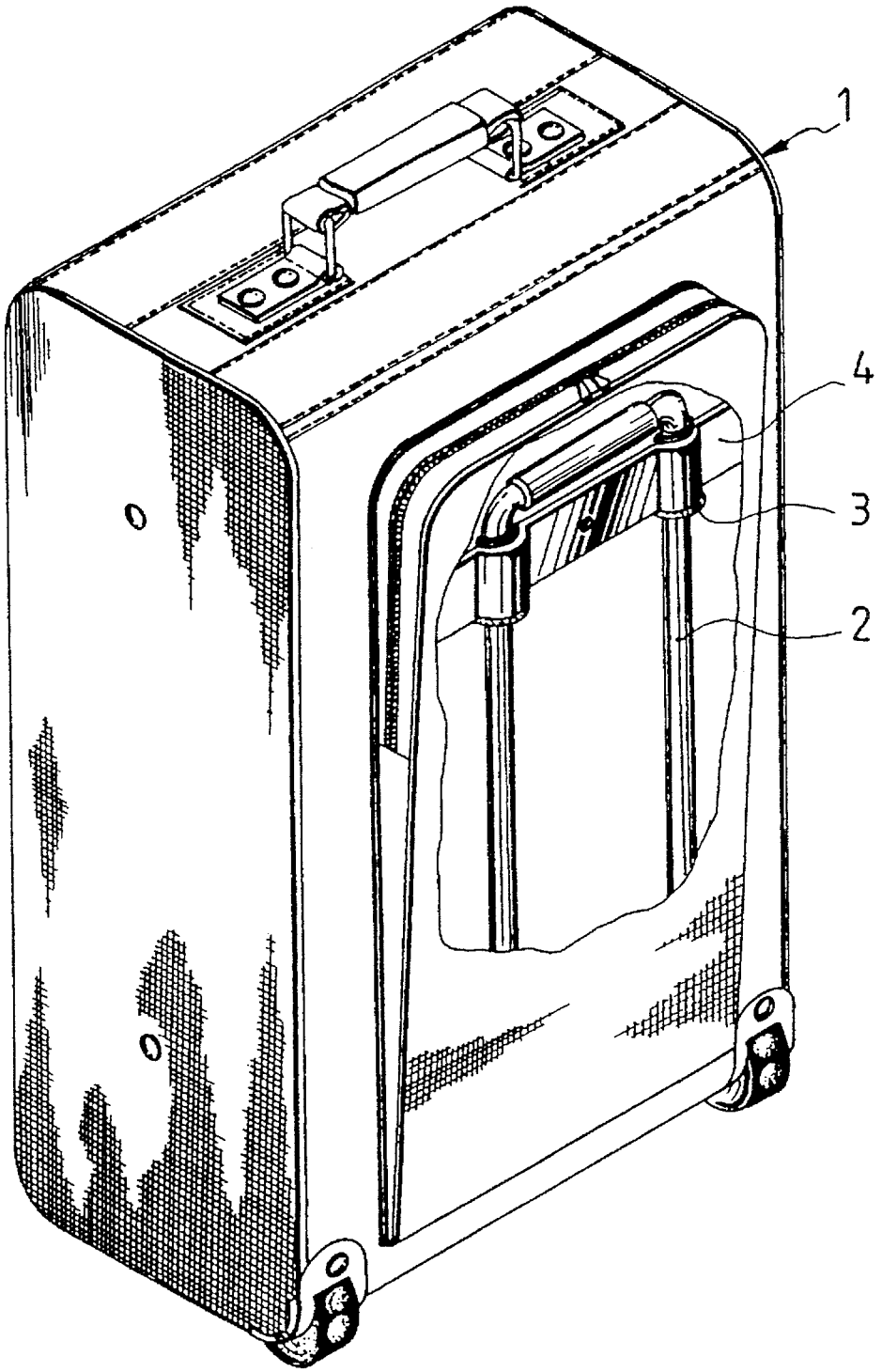
FIG. 2 is a perspective view, partly broken away of the suitcase incorporated with the retractable mechanism.
Figure 3:
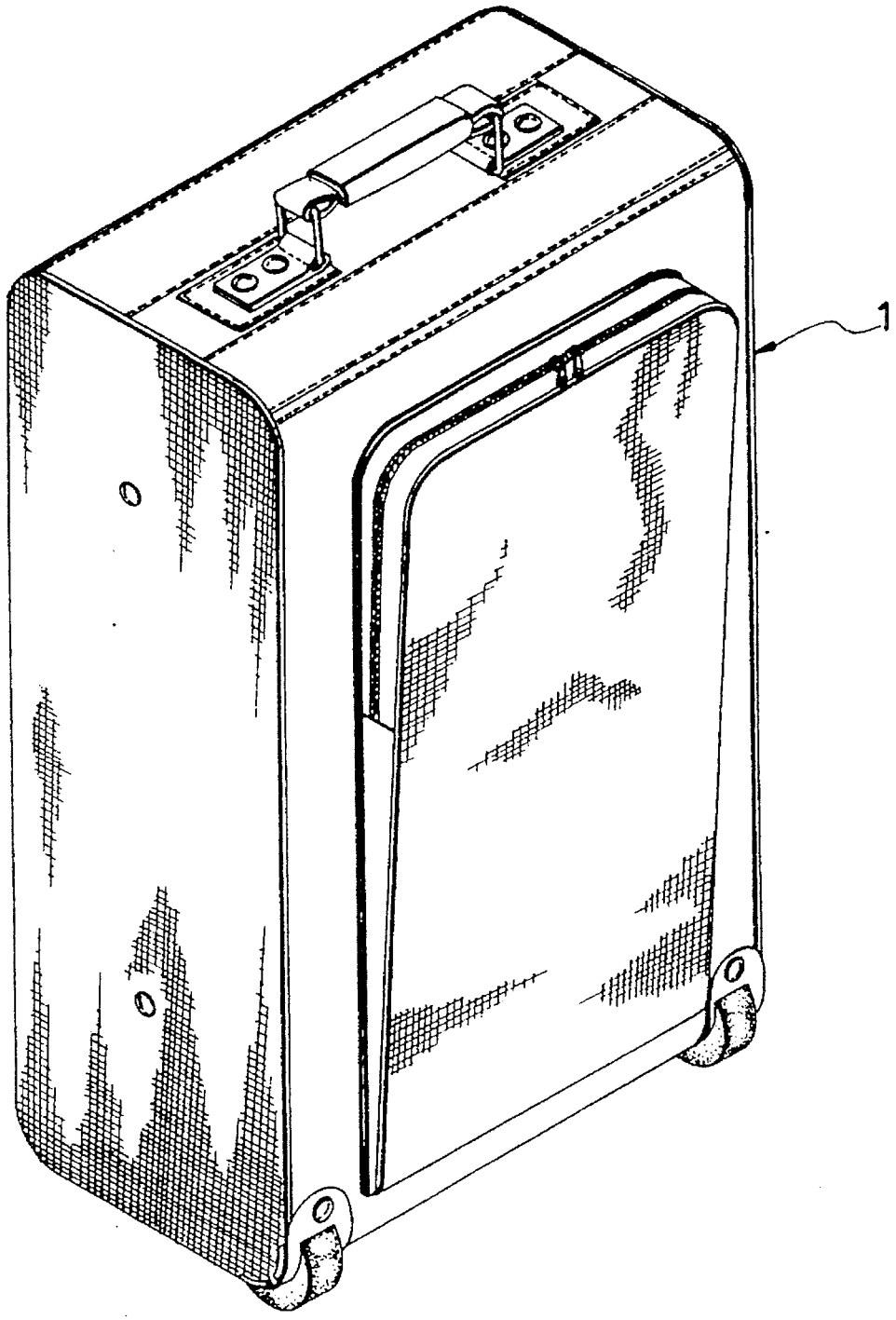
FIG. 3 is still a perspective view of the suitcase incorporated with the retractable mechanism which is completely hidden.

Referring to FIGS. 1 and 2, the retractable mechanism made according to this invention is designed to install in a sandwiched pocket of the bottom side of the suitcase 1. The pocket is incorporated with an opening incorporated with a zipper which can be easily opened and closed. The supporting mechanism generally includes a rod assembly 2, a retaining bushing assembly 3 and a retaining plate 4. This supporting mechanism can be readily attached to the main frame 5 of the suitcase 1.

Now a detailed description will be given in conjunction with the attached drawings.

The rod assembly 2 is made from rigid material and generally has a rectangular configuration.

The bushing assembly 3 is generally made from plastic material and has a C-shape cross section. Each bushing of bushing assembly 3 is provided with a flange 31 at the upper and lower ends thereof. The bushing assembly 3 provides a pair of passages within which the sides rods 21 of the rod assembly 2 can be slidably retained.

The retaining plate 4 is generally made from a rigid metal sheet. The retaining plate 4 is provided from a pair of retaining slots 41 which are spaced with each other a predetermined distance with respect to the main frame 5 of the suitcase 1. A plurality of holes 42 are also provided on the retaining plate 4.

The suitcase 1 is generally configured by a main frame 5. This main frame 5 generally includes a rectangular bracket 51 . A pair of longitudinal supporting bars 52 are bridged in parallel on the bracket 51 in the longitudinal direction. A transverse supporting bar 53 is bridged on the bracket 51 traverse to the longitudinal supporting bar 52. The longitudinal supporting bar 52 and the traverse supporting bar 53 are interconnected to provide a rigid support. The traverse supporting bar 53 is also provided with a plurality of positioning holes 531 aligned with the holes 42 of the retaining plate 4.

In assembling of these described elements, each bushing of the bushing assembly 3 is retained onto respective side rod 21 of the rod assembly 2. Then the retaining plate 4 is used to attach the bushing assembly 3 together with the rod assembly 2 onto the traverse supporting bar 53 in such a manner that the bushing assembly 3 is received by the retaining slots 41 of the retaining plate 4. When these elements are accurately positioned, a plurality of screw 6 or the like are used to thread into the holes 42 and 531. Accordingly, the rod assembly 2 is slidably attached to the traverse supporting bar 53 by means of the bushing assembly 3. On the other hand, the retaining slots 41 are disposed between the flanges 31 of the bushing 3, hence the bushing assembly 3 is firmly retained by the retaining slots 41 of the retaining plate 4.

Figure 4:
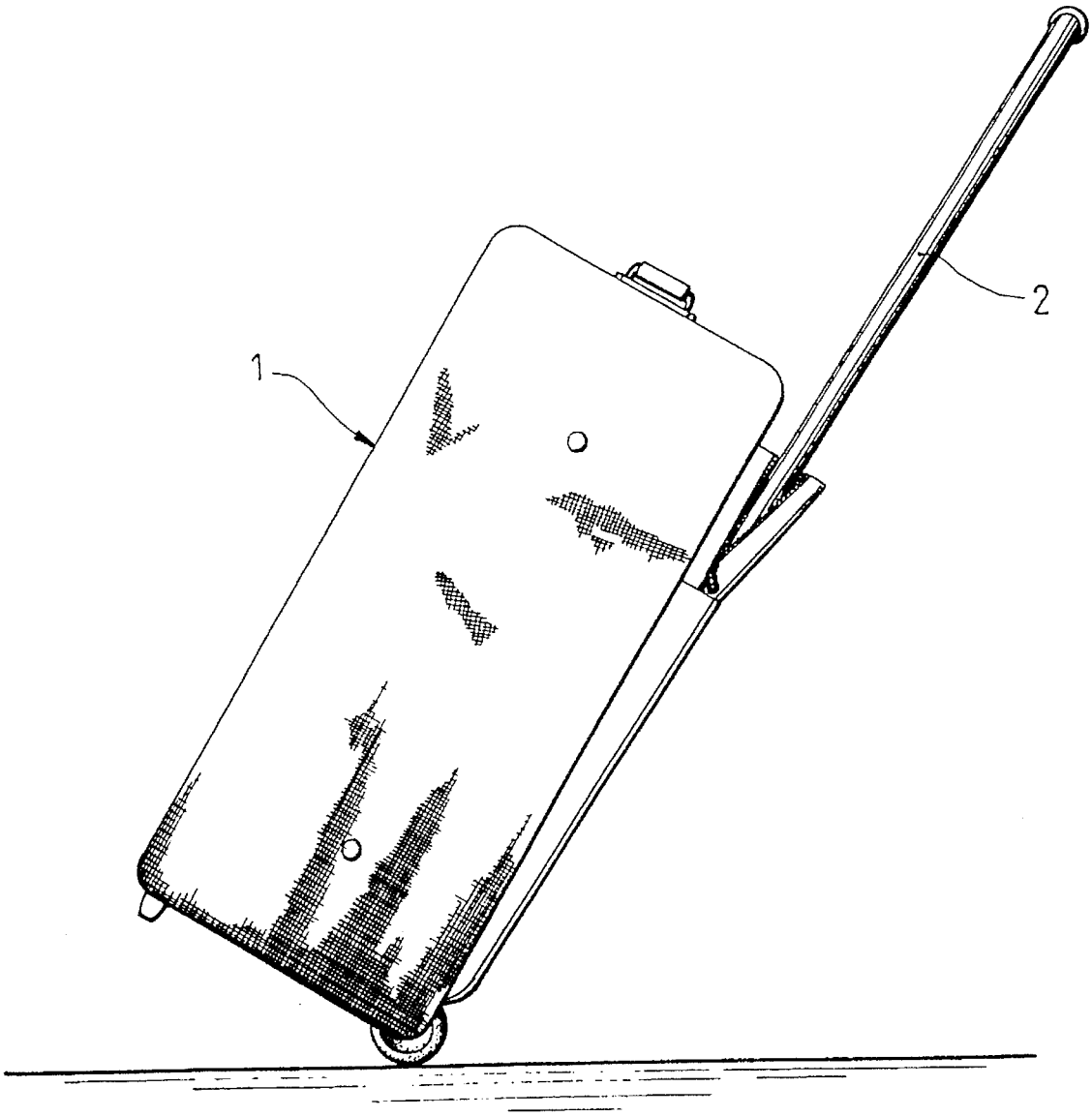
FIG. 4 is a side elevational view of the suitcase incorporated with the retractable mechanism wherein the handle is fully extended.

By this arrangement, the rod assembly 2 can be pulled out to a fully extended position when in use, as clearly shown in FIG. 4. On the other hand, the rod assembly 2 is readily retracted into its fully retracted position when not in use. Besides, the zipper of the pocket can be easily closed to cover the supporting mechanism.

In use, the zipper can be readily opened to provide access to the top rod 22 of the rod assembly 2. The top rod 22 can be readily pulled out to its full extent until the bottom rod 23 engages the retaining plate 4. As a result, the suitcase 1 can be easily handled and transported through the provision of the wheel assembly and the rod assembly 2. Besides, since the bottom rod 23 is limited by the retaining plate 4, the rod assembly 2 cannot be pulled out. Thus the defects and problems of the conventional supporting mechanism of a conventional suitcase are completely solved.

Although the present invention has been described in connection with the preferred embodiments thereof, many other variations and modifications will become apparent to those skilled in the art without departing from the scope of the invention. It is preferred, therefore, that the present invention not be limited by the specific disclosure herein, but only by the appended claim.

I claim:

1. A retractable handle mechanism for a suitcase comprising:

a) a mainframe including a rectangular bracket, a pair of parallel longitudinal bars and a transverse bar bridging the longitudinal bars, and means for connecting the longitudinal bars and transverse bar to the main frame;

b) a rectangular handle assembly including a pair of side rods, a top rod and a bottom rod;

c) a bushing assembly including a pair of bushings, each bushing being of a C-shaped cross section and provided with an upper end flange and a lower end flange; and d) a retaining plate and means for securing the bushing assembly and the handle assembly to the transverse bar, the retaining plate including a pair of slots formed therein, the bushings being engaged within the slots such that the slots are positioned between the upper and lower end flanges of the bushings and the side rods of the handle assembly being slidably received within the bushing assembly for permitting the handle assembly to be selectively disposed between a position of full extension, wherein the bottom rod engages the retaining plate to prevent removal of the handle assembly, and a position of full retraction.

2. The handle mechanism of claim 1 wherein said means for securing comprises:

a) a plurality of corresponding holes formed in the transverse bar and retaining plate; and b) a plurality of mechanical fasteners engaged within the corresponding holes for securing the retaining plate to the transverse bar.

* * * * *